US011859639B2

(12) United States Patent
Kim et al.

(10) Patent No.: US 11,859,639 B2
(45) Date of Patent: Jan. 2, 2024

(54) FAN MOTOR AND MANUFACTURING METHOD OF THE SAME

(71) Applicant: LG Electronics Inc., Seoul (KR)

(72) Inventors: Changlae Kim, Seoul (KR); Byungjik Kim, Seoul (KR); Sunggi Kim, Seoul (KR); Sanghyun Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 129 days.

(21) Appl. No.: 17/510,793

(22) Filed: Oct. 26, 2021

(65) Prior Publication Data

US 2022/0042521 A1 Feb. 10, 2022

Related U.S. Application Data

(63) Continuation of application No. 16/540,451, filed on Aug. 14, 2019, now Pat. No. 11,187,245.

(30) Foreign Application Priority Data

Aug. 22, 2018 (KR) ..... 10-2018-0098085

(51) Int. Cl.
*F04D 29/52* (2006.01)
*F04D 29/62* (2006.01)
(Continued)

(52) U.S. Cl.
CPC ..... *F04D 29/526* (2013.01); *F01D 5/288* (2013.01); *F04D 29/162* (2013.01);
(Continued)

(58) Field of Classification Search
CPC ... A47L 5/22–38; F04D 29/281; F04D 29/16; F04D 29/162; F04D 29/4226; F04D 29/526; F04D 29/622
See application file for complete search history.

(56) References Cited

U.S. PATENT DOCUMENTS 4,018,944 A 4/1977 Hallstrom et al.
5,967,747 A * 10/1999 Burke ..... A47L 5/22 415/206
(Continued)

FOREIGN PATENT DOCUMENTS

EP 1609953 12/2005
EP 1609953 A1 * 12/2005 ..... F01D 11/122
(Continued)

OTHER PUBLICATIONS

EP Search Report in European Application No. EP 19187571, dated Jan. 16, 2020, 3 pages.
(Continued)

*Primary Examiner* — Topaz L. Elliott
(74) *Attorney, Agent, or Firm* — Fish & Richardson P.C.

(57) ABSTRACT

A fan motor according to an embodiment of the present invention may include: an impeller a hub connected to a rotary shaft and at least one blade formed on the outer surface of the hub; a shroud surrounding the outer circumference of the impeller; and a coating layer coated on the inner circumferential surface of the shroud. The coating layer may include: a polymer having strength lower than the strength of the blade; and a plurality of beads mixed with the polymer and having strength higher than the strength of the polymer.

15 Claims, 10 Drawing Sheets

(51) Int. Cl.

| | |
|---|---|
| ***F01D 5/28*** | (2006.01) |
| ***F04D 29/22*** | (2006.01) |
| ***F04D 29/66*** | (2006.01) |
| ***F04D 29/16*** | (2006.01) |

(52) U.S. Cl.
CPC ..... *F04D 29/2222* (2013.01); *F04D 29/622* (2013.01); *F04D 29/666* (2013.01)

(56) References Cited

U.S. PATENT DOCUMENTS

| | | | | |
|---|---|---|---|---|
| 6,334,617 | B1 | 1/2002 | Putnam et al. | |
| 6,884,392 | B2 | 4/2005 | Malkin et al. | |
| 7,255,929 | B2 | 8/2007 | Turnquist et al. | |
| 8,020,875 | B2 | 9/2011 | Putnam et al. | |
| 9,534,503 | B2 * | 1/2017 | Isogai | F01D 11/122 |
| 9,752,593 | B2 * | 9/2017 | Bagnall | F01D 11/122 |
| 10,598,189 | B2 | 3/2020 | Liu et al. | |
| 11,187,245 | B2 * | 11/2021 | Kim | F04D 29/622 |
| 11,306,730 | B2 * | 4/2022 | Kim | F04D 29/043 |
| 11,441,570 | B2 * | 9/2022 | Hwang | F04D 29/162 |
| 2004/0022625 | A1 * | 2/2004 | Care | F01D 11/122 415/173.3 |
| 2004/0109760 | A1 | 6/2004 | Jones | |
| 2013/0004305 | A1 | 1/2013 | Giovannetti et al. | |
| 2013/0323034 | A1 * | 12/2013 | Isogai | F04D 29/023 415/173.4 |
| 2014/0294582 | A1 * | 10/2014 | Fujioka | F04D 29/023 29/889.23 |
| 2014/0356131 | A1 * | 12/2014 | Park | F04D 29/162 415/113 |
| 2015/0139787 | A1 | 5/2015 | Philippe et al. | |
| 2016/0177971 | A1 * | 6/2016 | Bagnall | F04D 29/38 451/28 |
| 2016/0327059 | A1 | 11/2016 | Amini et al. | |
| 2017/0276142 | A1 | 9/2017 | Graham | |
| 2017/0314572 | A1 | 11/2017 | Badeau et al. | |
| 2021/0408868 | A1 * | 12/2021 | Park | H02K 7/14 |

FOREIGN PATENT DOCUMENTS

| | | | | |
|---|---|---|---|---|
| EP | 2857693 | A1 * | 4/2015 | F04D 29/023 |
| EP | 3293399 | A1 * | 3/2018 | F04D 29/023 |
| KR | 19980079398 | | 11/1998 | |
| KR | 1020120095407 | | 8/2012 | |
| KR | 20130091841 | | 8/2013 | |
| KR | 1020130091841 | | 8/2013 | |
| KR | 1020170022920 | | 3/2017 | |
| WO | WO2018199550 | | 11/2018 | |

OTHER PUBLICATIONS

Office Action in Korean Appln. No. 10-2019-0147839, dated Aug. 12, 2021, 56 pages (with English translation).
Taiwanese Office Action in Taiwanese Application No. 10920630940, dated Jul. 3, 2020, 19 pages (with English translation).

* cited by examiner

FAN MOTOR AND MANUFACTURING METHOD OF THE SAME

CROSS REFERENCE TO RELATED APPLICATION

The present application is a continuation of U.S. application Ser. No. 16/540,451, filed on Aug. 14, 2019, which claims priority to Korean Patent Application No. 10-2018-0098085, filed on Aug. 22, 2018, the entire contents of which are incorporated herein for all purposes by reference.

BACKGROUND OF THE INVENTION

Field of the Invention

The present invention relates to a fan motor and a manufacturing method the same and, more particularly, to a fan motor having an impeller cover surrounding the outer circumferential surface of an impeller, and a method of manufacturing the fan motor.

Description of the Related Art

A fan motor may be installed in home appliances such as a cleaner, an air conditioner, or a laundry machine, or vehicles and may generate airflow.

When a fan motor is installed in a home appliance such as a cleaner, it may generate a suction force that suctions air first into a dust collector.

Such a fan motor, for example, may include a motor, an impeller connected to the motor, and an impeller cover surrounding the outer circumferential surface of the impeller.

The impeller may be connected to a rotary shaft of the motor, so when the rotary shaft is rotated, the impeller can suction air into the impeller cover by rotating inside the impeller cover.

The impeller may include a plurality of blades and may be mounted with a tip clearance between the blades and the inner circumferential surface of the impeller cover.

When the tip clearance is too small, the blades or the impeller cover may wear, but when it is too large, excessive leakage flow slides over the tips of the blades, so the efficiency of the fan motor may be deteriorated.

Documents of Related Art (Patent Document 1) KR 10-2013-0091841 A (published on Aug. 20, 2013)

SUMMARY OF THE INVENTION

An object of the present invention is to provide a fan motor of which the efficiency can be increased by minimizing leakage flow between an impeller and a shroud, and a method of manufacturing the fan motor.

In a fan motor according to an embodiment of the present invention, a coating layer coated on the inner circumferential surface of a shroud includes a polymer and a bead having hardness higher than the polymer, so the coating layer can be more precisely ground by a blade of an impeller and leakage flow between the impeller and the shroud can be minimized.

In more detail, a fan motor according to an embodiment of the present invention may include: an impeller a hub connected to a rotary shaft and at least one blade formed on the outer surface of the hub; a shroud surrounding the outer circumference of the impeller; and a coating layer coated on the inner circumferential surface of the shroud. The coating layer may include: a polymer having hardness lower than the hardness of the blade; and a plurality of beads mixed with the polymer and having hardness higher than the hardness of the polymer.

A portion of the coating layer may be ground by the blade, whereby a gap between the coating layer and the blade can be minimized. In more detail, the coating layer may include: a first area having a first thickness; and a second area having a second thickness smaller than the first thickness and having a step from the first area, in which the blade may face the second area in the radial direction of the impeller.

The blade includes a material having hardness higher than the polymer of the coating layer, thereby being able to minimize wear of the blade when the blade grinds the coating layer. In more detail, the blade may include PEEK and the polymer may include silicon-based resin.

The polymer may have hardness such that the coating layer is not severely worn and the blade grinding the coating layer is not worn. In more detail, the polymer may have hardness of 30 Shore A to 50 Shore A.

The bead mixed with the soft polymer may be hard, whereby the coating layer can be precisely ground. In more detail, the bead may include ceramic. In more detail, the bead may include an aluminum oxide.

The mixing ratio of the bead included in the coating layer may be in the range where the adhesion of the coating layer to the inner wall of the shroud can be maintained. In more detail, the bead may be included by 0.1 wt % to 10 wt % with respect to the coating layer of 100 wt %.

The bead may have a diameter in the range where the bead is uniformly mixed with the polymer and the coating layer can be precisely ground. In more detail, the diameter of the bead may be 0.01 mm to 0.1 mm.

In the fan motor according to an embodiment of the present invention, a second thickness of a second area of the coating layer may change in the inner circumferential direction of the shroud. Accordingly, even if the rotational axis of the impeller is eccentric to the center axis of the shroud, leakage flow between the impeller and the shroud can be minimized.

In more detail, a fan motor according to an embodiment of the present invention may include: an impeller a hub connected to a rotary shaft and at least one blade formed on the outer surface of the hub; a shroud surrounding the outer circumference of the impeller; and a coating layer including a polymer and coated on the inner circumferential surface of the shroud. The coating layer may include: a first area having a first thickness; and a second area facing the impeller in the radial direction of the impeller and having at least a portion having a second thickness smaller than the first thickness. The second thickness may change in the inner circumferential direction of the shroud.

Further, the rotary shaft may be eccentric to a virtual axis of the shroud. Accordingly, the blade of the impeller can grind the coating layer such that the second thickness of the second area changes in the inner circumferential direction of the shroud.

A gap between the blade and the second area may change in the circumferential direction of the impeller.

The thickness of a portion of the second area may be the same as the first thickness.

On the other hand, a method of manufacturing a fan motor according to an embodiment of the present embodiment includes forming a coating layer including a polymer and a bead mixed with the polymer on the inner circumferential surface of a shroud, and rotating the impeller while inserting the impeller in to the shroud, whereby a portion of the coating layer can be precisely ground by a blade of the impeller.

In more detail, a method of manufacturing a fan motor according to an embodiment of the present invention may include: manufacturing an impeller cover by forming a coating layer having a first thickness on the inner circumferential surface of a shroud; and rotating the impeller having a blade while inserting the impeller into the shroud, in which the coating layer may include: a polymer having hardness lower than the hardness of the blade; and a plurality of beads mixed with the polymer and having hardness higher than the hardness of the polymer, and when the impeller is rotated, the blade may grind a portion of the coating layer to have a second thickness smaller than the first thickness.

Further, when the impeller is rotated, the polymer may be ground along cracks connecting at least some of the plurality of beads. Accordingly, the coating layer can be more precisely ground by the blade.

Further, the blade includes a material having hardness higher than the polymer of the coating layer, thereby being able to minimize wear of the blade when the blade grinds the coating layer. In more detail, the blade may include PEEK and the polymer may include silicon-based resin.

The polymer may have hardness such that the coating layer is not severely worn and the blade grinding the coating layer is not worn. In more detail, the polymer may have hardness of 30 Shore A to 50 Shore A.

The bead mixed with the soft polymer may be hard, whereby the coating layer can be precisely ground. In more detail, the bead may include ceramic. In more detail, the bead may include an aluminum oxide.

The mixing ratio of the bead included in the coating layer may be in the range where the adhesion of the coating layer to the inner wall of the shroud can be maintained. In more detail, the coating layer may include the bead by 0.1 wt % to 10 wt %.

The bead may have a diameter in the range where the bead is uniformly mixed with the polymer and the coating layer can be precisely ground. In more detail, the diameter of the bead may be 0.01 mm to 0.1 mm.

According to a preferred embodiment of the present invention, there is the advantage that it is possible to reduce a loss of channels and improve the efficiency of a fan motor by minimizing leak flow that slides over a pressure-side surface to a suction-side surface of a blade.

Further, there is the advantage that even if there is an injection-molding error of a blade and an assembly tolerance of the fan motor, the error or tolerance can be compensated in accordance with the ground depth of the coating layer and the reliability of maintaining a minimum air cap is high.

Further, there is the advantage that even if the propulsion of the impeller increases and the impeller comes close to the coating layer while the fan motor is used, a portion of the remaining coating layer is ground, thereby being cope with the increase of the propulsion.

Further, there is the advantage that since the bead is included in the coating layer, the coating layer can be precisely ground without being excessively cut off when the coating layer is ground by the blade. Accordingly, the gap between the ground surface of the coating layer and the blade can be minimized, and the leak flow that slides over a pressure-side surface to a suction-side surface of a blade is minimized, so a loss of channels is reduced and the efficiency of the fan motor is improved.

Further, there is the advantage that since the polymer of the coating layer has hardness lower than the blade, the blade is not worn.

Further, there is the advantage that since the polymer of the coating layer is soft, the polymer is smoothly ground even if the output of the fan motor is slightly low.

Further, there is the advantage that since the polymer is a silicon material and the bead is an alumina material, there is no peculiarity of materials, so coating is easy and accordingly cost reduction can be expected.

Further, there is the advantage that since the hard bead is mixed with the soft polymer in the coating layer, stress that is transmitted into the polymer by the blade can concentrate around the bead and cracks connecting the beads can be formed in the polymer. Accordingly, a portion of the polymer can be cut off along the cracks and excessive cutting-off of the polymer is prevented.

Further, there is the advantage that since there is the coating layer between the blade and the inner circumferential surface of the shroud, the concern of damage to the inner circumferential surface of the shroud due to contact with the blade is prevented.

Further, there is the advantage that since the impeller is inserted in the shroud and grinds the coating layer, the manufacturing cost of the fan motor is reduced in comparison to a manufacturing method of precisely machining a coating layer and then inserting an impeller into a shroud.

Further, there is the advantage that since the second thickness of the second area changes in the inner circumferential direction of the shroud, the gap between the blade and the inner circumference of the blade can be minimized even if the rotational axis of the impeller is eccentric to the virtual center axis of the shroud.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Exemplary embodiments of the present invention will be described in detail hereafter with reference to the accompanying drawings.

Figure 1:
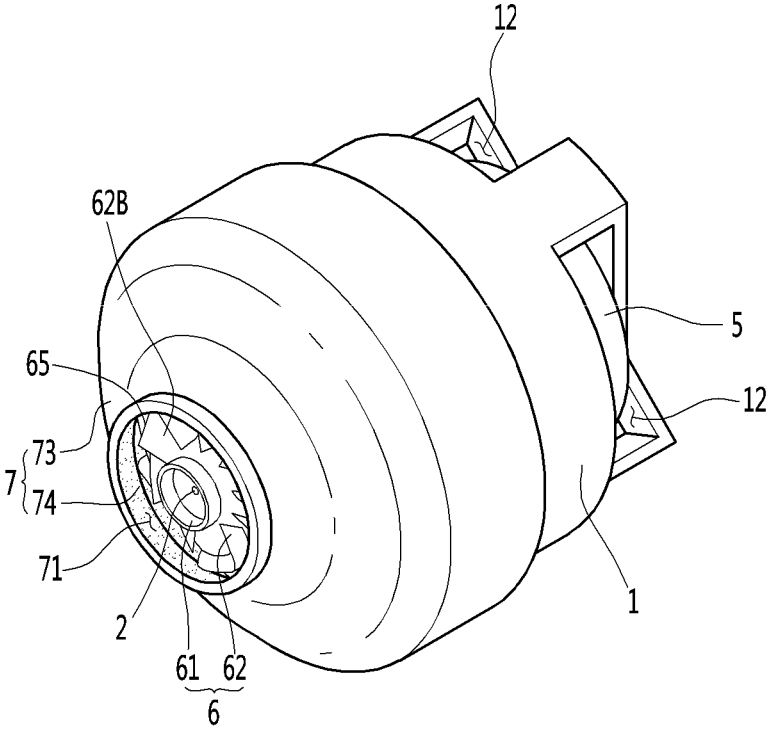
FIG. 1 is a perspective view of a fan motor according to an embodiment of the present invention.
Figure 2:
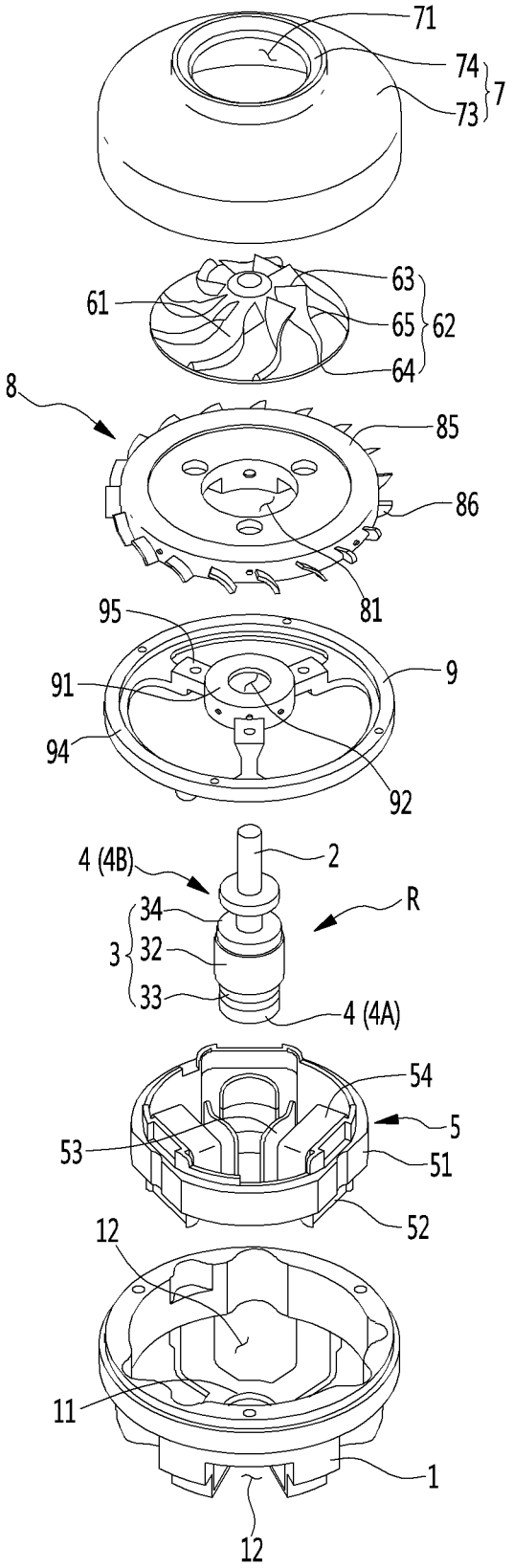
FIG. 2 is an exploded perspective view of the fan motor according to an embodiment of the present invention.
Figure 3:
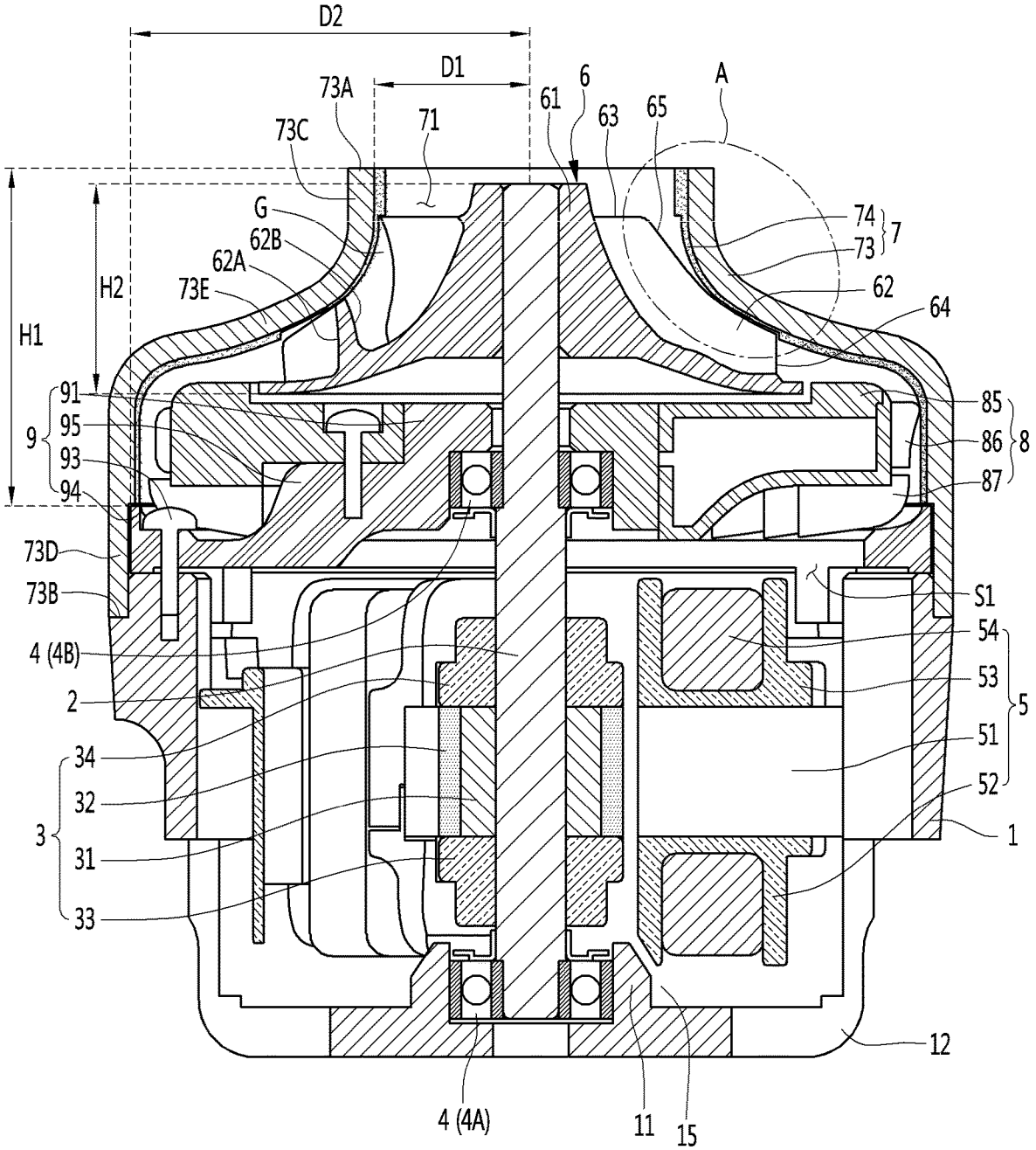
FIG. 3 is a cross-sectional view showing the inside of the fan motor according to an embodiment of the present invention.

FIG. 1 is a perspective view of fan motor according to an embodiment of the present invention, FIG. 2 is an exploded perspective view of the fan motor according to an embodiment of the present invention, and FIG. 3 is a cross-sectional view showing the inside of the fan motor according to an embodiment of the present invention.

A fan motor according to the present embodiment may include: a motor housing 1; a rotary shaft 2, a rotor 3 mounted on the rotary shaft 2; a stator 5 disposed inside the motor housing 1 and surrounding the rotor 3; an impeller 6 connected to the rotary shaft 2; and an impeller cover 7 surrounding the outer circumferential surface of the impeller 6. The impeller cover 7 may include a coating layer 74 for minimizing the gap between the impeller 6 and the impeller cover 7.

A space S1 where the rotor 3 and the stator 5 are accommodated may be formed inside the motor housing 1.

A bearing housing portion 11 for supporting a bearing 4 to be described below may be formed at the motor housing 1.

An air outlet 12 through which air flowing in the space S1 by the impeller 6 is discharged to the outside may be formed at the motor housing 1.

The rotor 3 and the bearing 4 may be mounted on the rotary shaft 2 and the rotary shaft 2 may constitute a rotary shaft assembly R together with the rotor 3 and the bearing 4.

The rotary shaft 2 may be elongated into the impeller cover 7 from the inside of the motor housing 1. A portion of the rotary shaft 2 may be positioned inside the motor housing 1 and the other portion of the rotary shaft 2 may be positioned inside the impeller cover 7. The rotary shaft 2 may be positioned inside the motor housing 1 and inside the impeller cover 7.

The rotary shaft 2, which rotates with the rotor 3, may be supported by the bearing 4. The rotary shaft 2 may be rotated by the rotor 3 while being rotated by the bearing 4.

The impeller 6 may be connected to the rotary shaft 2, and when the rotary shaft 2 is rotated, the impeller 6 may be rotated inside the impeller cover 7.

The rotor 3 may be mounted to surround a portion of the rotary shaft 2. The rotor 3 may be rotatably positioned in the stator 5. The rotor 3 may be formed in a hollow cylindrical shape.

The rotor 3 may include a rotor core 31 fixed to the rotary shaft 2, a magnet 32 installed on the rotor core 31, and a pair of end plates 33 and 34 fixing the magnet 32.

The rotor 3 may be mounted to surround a portion between an end and the other end of the rotary shaft 2.

At least one bearing 4 may be installed on the rotary shaft 2. A pair of bearings 4A and 4B may be disposed on the rotary shaft 2.

Any one 4A of the pair of bearings 4 may be supported by the bearing housing portion 11 formed at the motor housing 1.

The other one 4B of the pair of bearings 4 may be supported by a bearing housing portion 91 formed at a motor bracket 9.

The stator 5 may be mounted in the motor housing 1. The stator 5 may be mounted in the motor housing 1 and may be disposed in the motor housing 1 to surround the rotor 3. The stator 5 may be mounted in the motor housing 1 by fasteners such as screws.

The stator 5 may be formed in a hollow cylindrical shape. The stator 5 may be mounted to surround the outer circumferential surface of the rotor 3.

The stator 5 may be configured as an assembly of several members. The stator 5 may include a stator core 51, a pair of insulators 52 and 53 combined with the stator core 51; and coils 54 disposed at the insulators 52 and 53.

The impeller 6 may be configured as a centrifugal impeller that axially suctions air and centrifugally blows the air and may be configured as a mixed-flow impeller that axially suctions air and blows the air diagonally between the axial direction and the centrifugal direction.

The impeller 6 may include a hub 61 connected to the rotary shaft 2 and at least one blade 62 formed on the outer surface of the hub 61.

The hub 61 may be connected to an end, which is positioned inside the impeller cover 7, of the rotary shaft 2.

A hole in which the rotary shaft 2 is inserted may be formed at the center of the hub 61.

The hub 61 may be formed in a shape of which the outer diameter gradually increases toward the rotor 3.

In the hub 61, the outer diameter of the end close to an air inlet 71 is the smallest and the outer diameter of the other end close to the rotor 3 may be may be the largest. The maximum outer diameter of the hub 61 may be the outer diameter of the end close to the rotor 3 of both ends of the hub 61.

A plurality of blades 62 may be formed on the outer surface of the hub 61 and the plurality of blades 62 may be spaced apart from each other in the circumferential direction of the impeller 6.

The blade may be formed in a curved plate shape and both sides thereof may include a pressure-side surface and a suction-side surface.

The blade 62 may be formed in a 3D shape and may include a leading edge 63 at the foremost end in the airflow direction and a trailing edge 64 at the rearmost end in the airflow direction.

The blade 62 may have a blade tip 65 positioned at the outermost side from the center axis of the hub 61. The blade tip 65 may be an outer tip positioned at the outermost side of the blade 62.

In the blade 62, the leading edge 63 and the trailing edge 64 may be connected to the blade tip 65. The blade tip 65 may connect the farthest tip from the hub 61 of the leading edge 63 and the farthest tip from the hub 61 of the trailing edge 64.

The blade tip 65 may include an air inlet-facing area 65A (see FIG. 4) axially facing the air inlet 71 and a coating layer-facing area 65B (see FIG. 4) axially facing the coating layer 74.

The entire blade tip 65 may radially face the coating layer 74.

When the impeller 6 is rotated, some of air blown by the impeller 6 can slide over the blade tip 65 by the pressure difference between the pressure-side surface 62A of the blade 62, and this flow may be leakage flow.

When the impeller 6 is rotated, relatively high pressure may be generated around the pressure-side surface 62A and relatively low pressure may be generated around the suction-side surface 62B. When the tip clearance between the blade tip 65 and the inner circumferential surface of the impeller cover 7 is large, air around the pressure-side surface 62A can slide over the blade tip 65 and move around the suction-side surface 62B and a vortex may be formed around the suction-side surface 62B.

When the tip clearance between the blade tip 65 and the impeller cover 7 is large, the amount of leakage flow is large, so it is preferable that the tip clearance is set such that leakage flow is minimized.

The impeller cover 7 may include a coating layer 74 that can minimize the leakage flow. The coating layer 74 may be formed in advance at the shroud 73 before the fan motor is assembled, and a portion of the coating layer 74 may be ground off by the blade 62 of the impeller 6 when the fan motor is assembled.

Hereafter, the impeller cover 7 is described in detail.

The air inlet 71 may be formed at the impeller cover 7. When the impeller 6 is rotated, the air outside the fan motor can be suctioned into the impeller cover 7 through the air inlet 71.

The impeller cover 7 may include the shroud 73 surrounding the outer circumferential surface of the impeller 6 and the coating layer 74 coated on the inner circumferential surface of the shroud 73.

The inner diameter of the shroud 73 may be increased in the airflow direction.

The shroud 73, which guides air being suctioned to the impeller 6, may have a structure of which the inner radius D1 of an end 73A and the inner radius D2 of the other end 73B are different. The shroud 73 may be formed such that the inner radius D2 of the other end 73B is larger than the inner radius D2 of the end 73A.

The shroud 73 may gradually increase in inner diameter from the end 73A to the other end 73B.

The shroud 73, for example, may be formed such that the entire area between the end 73A and the other end 73B gradually increases in inner diameter in the airflow direction. Further, the impeller 6 may be positioned inside the shroud 73 and the entire blade tip 65 may radially faces the shroud 73.

The shroud 73, as another example, may include a small-diameter portion 73C, a large-diameter portion 73D, and an expanding portion 73E.

The small-diameter portion 73C includes the end 73A of the shroud 73 and may be smaller in inner diameter than the large-diameter portion 73D. The air inlet 72 through which the air outside the fan motor flows into the shroud 73 may be formed in the small-diameter portion 73C.

The large-diameter portion 73D includes the other end 73B of the shroud 73 and may be larger in inner diameter than the small-diameter portion 73C.

The expanding portion 73E may connect the small-diameter portion 73C and the large-diameter portion 73D and may be formed such that the inner diameter gradually increases. The expanding portion 73E may be positioned between the small-diameter portion 73C and the large-diameter portion 73D in the airflow direction, air can flow into the expanding portion 73E through the inside the small-diameter portion 73C and can flow into the large-diameter portion 73D from the expanding portion 73E. Further, the impeller 6 may be positioned inside the small-diameter portion 73C and inside the expanding portion 73E, some area of the blade tip 65 may radially face the small-diameter portion 73C, and the other area of the blade tip 65 may radially face the expanding portion 73E.

The shroud 73, as another example, may include a large-diameter portion 73D and an expanding portion 73E without the small-diameter portion 73C. In this case, the expanding portion 73E may include the end 73A of the shroud 73, the air inlet 71 through which external air is suctioned into the fan motor may be formed at the expanding portion 73E, and the inner diameter of the expanding portion 73E may gradually increase toward the large-diameter portion 73D. Further, the impeller 6 may be positioned inside the expanding portion 73E and the blade tip 65 may radially faces the expanding portion 73E.

The shroud 73 may be formed integrally with the motor housing 1.

The coating layer 74 may be formed on the inner circumferential surface of the shroud 73.

The coating layer 74 is not ground through a separate grinding process and may be ground by the blade 62 when the fan motor is assembled. That is, a portion of the coating layer 74 may be cut off by the blade 62 when the fan motor is assembled. The coating layer 74 may be a kind of self-sacrifice coating.

In order to be smoothly ground by the blade 62, the coating layer 74 may include a soft polymer 74A having hardness lower than the hardness of the blade 62.

It is preferable that the coating layer 74 is formed to be able to surround a portion of the leading edge 63, the entire of the blade tip 65, and a portion of the trailing edge 64.

To this end, the height H1 of the coating layer 74 may be larger than the height H2 of the impeller 6. The height H1 of the coating layer 74 and the height H2 of the impeller 6 may be the axial length of the fan motor. Further, when the fan motor is assembled, the coating layer may be disposed to surround the entire outer circumferential surface of the impeller 6.

The coating layer 74 will be described in more detail later.

On the other hand, the maximum outer diameter of the impeller 6 may be larger than the diameter of the air inlet 71.

The maximum outer diameter of the impeller 6 may be larger than the minimum inner diameter of the small-diameter portion 73C and may be smaller than the maximum inner diameter of the expanding portion 73E.

The maximum outer diameter of the impeller 6 may be the larger outer diameter of the maximum outer diameter of the hub 61 and the maximum outer diameter of the blade 62.

The maximum outer diameter of the blade 62 may be double the maximum distance between the rotational center axis of the impeller 6 and the blade tip 65.

The closer the blade tip 65 goes to the rotor 3, the farther the blade tip 65 may go away from the rotational center axis of the impeller 6, and the maximum outer diameter of the blade 62 may be double the distance from the rotational center axis of the impeller 6 to the tip that is the farthest from the hub 61 of the blade tip 65.

That is, the maximum distance between the center axis of the impeller 6 and the blade tip 65 of the blade 62 may be the maximum radius of the impeller 6 and the maximum radius of the impeller 6 may be larger than the radius of the air inlet 71.

On the other hand, the fan motor may further include a diffuser 8 that guides air blown by the impeller 6. The air blown from the impeller 6 may be guided by the diffuser 8.

The diffuser 8 may be disposed inside the impeller cover 7. The diffuser 8 may be mounted on at least one of the motor housing 1 and the motor bracket 9 to be described below. A gap through which air that is guided to the diffuser 8 can pass may be formed between the diffuser 8 and the impeller cover 7.

The diffuser 8 may partially face the impeller 6 and a gap may be formed between a surface of the diffuser 8 and the diffuser-facing surface of the impeller 6.

The diffuser 8 may have a hole 81 surrounding the outer circumferential surface of the bearing housing portion 9.

The diffuser 8 may include a body part 85 being larger in size than the impeller cover 7 and positioned inside the impeller cover 7, and diffuser vanes 86 protruding from the outer circumferential surface of the body part 85.

The body part 85 can guide air centrifugally blown from the impeller 6 to the inner circumferential surface of the impeller cover 7, between the impeller 6 and the stator 5, and the air that has passed through the outer circumferential surface of the body part 85 and the inner circumferential surface of the impeller cover 7 can be guided between the body part 85 and the stator 5.

The diffuser vanes 86 may protrude from the body part to be positioned between the outer circumferential surface of the body part 85 and the impeller cover 7. The diffuser vane 86 can convert the dynamic pressure of the air, which has passed through the impeller 6, into static pressure.

The diffuser 8 may further include guide vanes 87 that guide air to the rotor 3 and the stator 5. The guide vanes 87 may be formed behind the diffuser vanes 86 in the airflow direction.

Further, the fan motor may further include the motor bracket 9 supporting the bearing 4.

The motor bracket 9 may be combined with at least one of the motor housing 1 and the diffuser 8. The bearing housing portion 91 accommodating the bearing 4 may be formed at the motor bracket 9. A rotary shaft-through hole 92 through which the rotary shaft 2 passes may be formed at the bearing housing portion 91.

The motor bracket 9 may be mounted in the motor housing 1. The motor bracket 9 may further include a fastening portion 94 fastened to the motor housing 1 by fasteners 93 such as screws. The motor bracket 9 may include at least one connecting portion 95 connecting the fastening portion 94 and the bearing housing portion 91.

Figure 4:
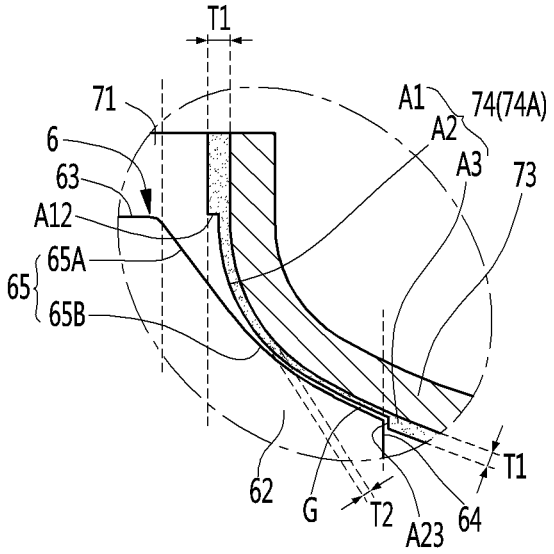
FIG. 4 is a cross-sectional view enlarging the portion A shown in FIG. 3.
Figure 5:
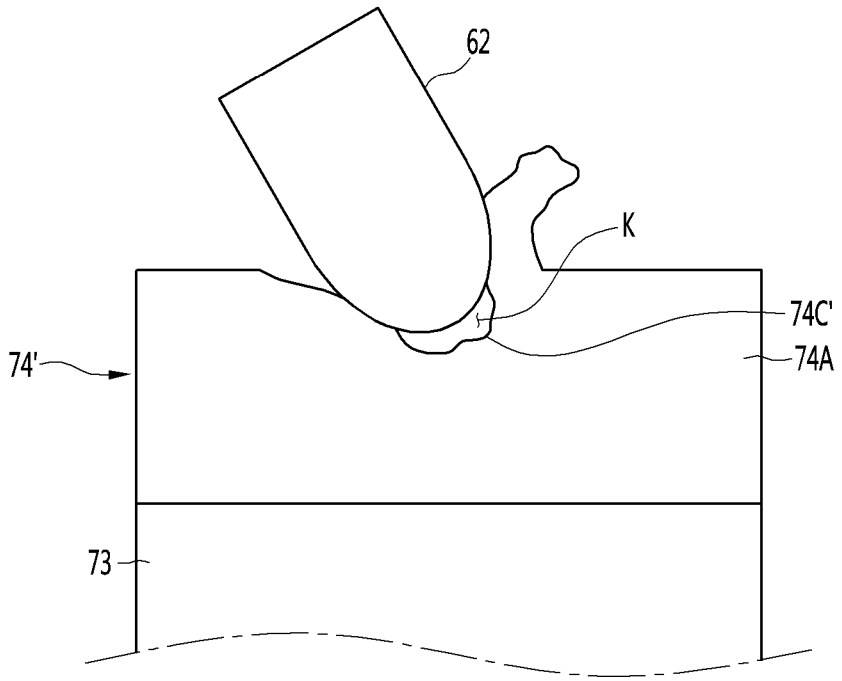
FIG. 5 is a view showing that a coating layer without a bead is ground by a blade.
Figure 6:
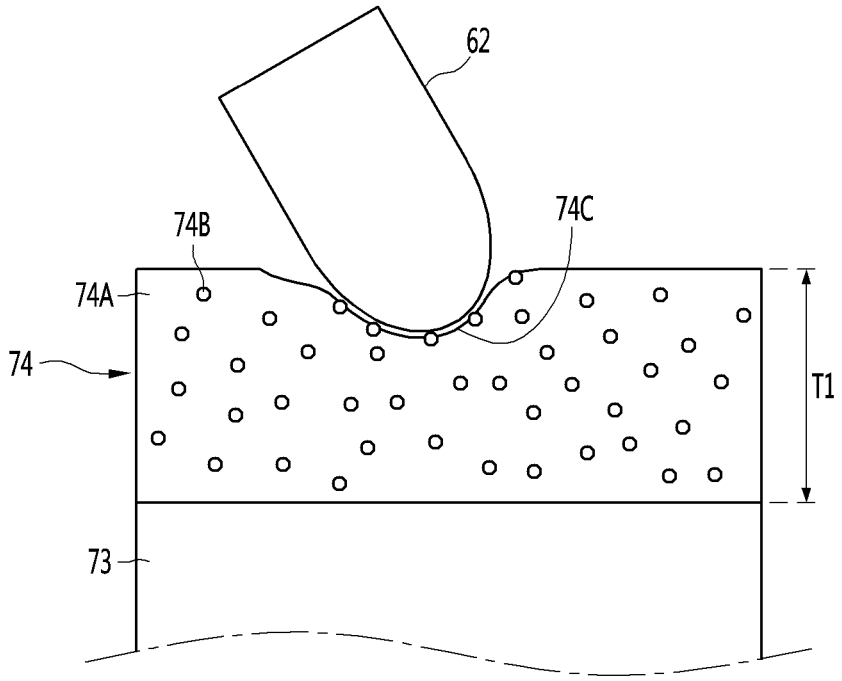
FIG. 6 is a view showing that a coating layer according to an embodiment of the present invention is ground by a blade.
Figure 7:
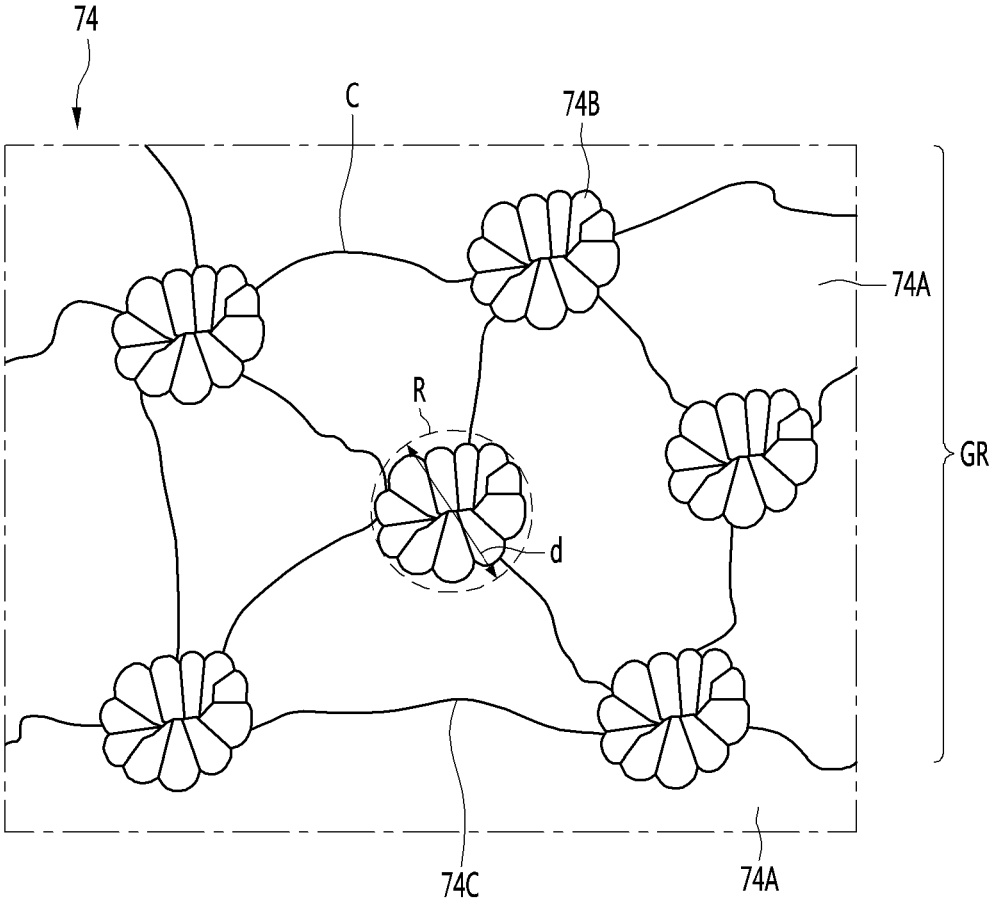
FIG. 7 is a view illustrating in detail the portion that is ground by a blade in a coating layer.

FIG. 4 is a cross-sectional view enlarging the portion A shown in FIG. 3, FIG. 5 is a view showing that a coating layer without a bead is ground by a blade, FIG. 6 is a view showing that a coating layer according to an embodiment of the present invention is ground by a blade, and FIG. 7 is a view illustrating in detail the portion that is ground by a blade in a coating layer.

As described above, the coating layer 74 is not ground through a separate grinding process and may be ground by the blade 62 when the fan motor is assembled.

In this case, that is, the portion that is ground by the blade 62 of the coating layer 74 may include a portion being in contact with the blade 62. In more detail, the blade 62 applies stress to the coating layer 74 in contact with the coating layer 74, the coating layer 74 is not accurately ground only at the portion being in contact with the blade 62, but may be ground even at a portion of the portion not being in contact with the blade 62. Accordingly, a fine gap may be formed between the blade 62 and the ground surface.

In order to minimize the gap, the coating layer 74 may include a polymer 74*a* having hardness lower than the hardness of the blade 62 and a plurality of beads 74B mixed with the polymer 74A and having hardness higher than the polymer 74A.

The polymer 74A may include soft polymer resin.

The hardness of the polymer 74A may be lower than the hardness of the blade 62. Accordingly, the polymer 74A can be easily ground by the blade 62, and in this process, damage to the blade 62 can be minimized.

The beads 74B may have hardness higher than the polymer 74A. That is, the polymer 74A may be soft and the beads 74B may be hard.

The plurality of beads 74B may be mixed with the polymer 74A and uniformly distributed in the polymer 74A. Further, some of the plurality of beads 74B may be positioned on the surface of the polymer 74A.

The plurality of beads 74B can prevent the coating layer 74 from being excessive cut off while the coating layer 74 is ground by the blade 62.

For example, a coating layer 74' without a bead may be composed of only a soft polymer 74A, as shown in FIG. 5. In this case, when the blade 62 comes in contact with the coating layer 74', stress of the blade 62 is transmitted into the soft polymer 74A, so crack may be generated in the polymer 74A. Since the cracks are randomly generated, a portion of the polymer 74A may be cut off in a lump, depending on the shape of the cracks.

Accordingly, the gap k between the ground surface 74C' formed on the polymer 74A and the blade 62 may increase and the efficiency of the fan motor may be reduced due to leakage flow of the air flowing through the gap k.

However, as shown in FIGS. 6 and 7, when the coating layer 74 includes beads 74B and the blade 62 comes in contact with the coating layer 74, cracks C that are formed by stress of the blade 62 may be formed to connecting at least some of a plurality of beads 74B to each other. This is because the stress that is applied into the soft polymer 74A concentrates around the hard beads 74B.

That is, unlike the coating layer without the bead 74B, the cracks C formed in the polymer 74A of the coating layer according to the present invention may be formed in accordance with a plurality of beads 74B and a portion GR of the polymer 74A may be separated along the cracks C.

Accordingly, the polymer 74A can be cut off in a relative lump and the gap between the ground surface 74C and the blade 62 can be minimized. Accordingly, the coating layer 74 can be precisely cut.

When the coating layer 74 is ground by the blade 62, some of a plurality of beads 74B may be positioned on the ground surface 74C of the polymer 74A. In this case, the beads 74B positioned on the ground surface 74C of the polymer 74A may be the beads 74B connected with the cracks C in the ground portion.

On the other hand, referring to FIG. 4, the coating layer 74 may include a first area A1 having a first thickness T1 and a second area A2 having a second thickness T2 smaller than the first thickness T1 and having a step from the first area A1. The second area A2 may continue after the first area A1 in the airflow direction. In this case, the plurality of beads 74B may be uniformly distributed in the first area A1 and the second area A2.

Further, the coating layer 74 may further include a third area A3 having the first thickness T1 and continues after the second area A2. In this case, the plurality of beads may be uniformly distributed in the first area A1, the second area A2, and the third area A3.

It is preferable that the coating layer 74 is formed to having a thickness that does not increase much the weight of the fan motor and considering the grinding depth by the blade 62 and the assembly tolerance of the impeller 6.

The thickness of the coating layer 74 may mean the thickness of the polymer 74A.

The coating layer 74 may have a uniform thickness in the airflow direction before the fan motor is assembled.

In more detail, the coating layer 74 may be formed with the first thickness on the inner circumferential surface of the shroud 73 before the fan motor is assembled. The first thickness T1 may be the same as or larger than the minimum distance between the inner circumferential surface of the shroud 73 and the blade 62.

For example, the minimum distance between the inner circumferential surface of the shroud 73 and the blade 62 may be 0.3 mm and the first thickness T1 may be 0.3 mm to 0.6 mm. When the first thickness T1 is smaller than 0.3 mm, the coating layer 74 may not be ground by the blade 62, and when the first thickness T1 is larger than 0.6 mm, the coating layer 74 may not be smoothly ground by the blade 62.

When the impeller 6 is rotated, the blade 62 can come in contact with a portion of the coating layer 74. In this case, in the coating layer 74 a portion including the portion brought in contact with the blade 62 can be ground by the blade 62.

The ground portion of the coating layer 74 can decrease in thickness from the first thickness T1 to the second thickness T2 and the non-ground portion can maintain the first thickness T1.

The portion not ground by the blade 62 of the coating layer 74 may be the first area A1 and the third area A3 and the remaining portion after a portion of the coating layer 74 is ground by the blade 62 may be the second area A2.

The second area A2 may include the ground surface 74C. In more detail, the surface of the second area A2 may be the ground surface 74C. Accordingly, some of the plurality of beads 74B included in the coating layer 74 may be positioned on the surface of the second area A2.

Meanwhile, the second thickness T2 of the second area A2 may be uniform or changed in the airflow direction.

When the second thickness T2 of the second area A2 is changed in the airflow direction, the thickness of the thickest portion of the second area A2 may be smaller than the first thickness T1 of each of the first area A1 and the third area A3. Further, when the second thickness T2 of the second area A2 is changed in the airflow direction, the average thickness of the second area A2 may be smaller than the first thickness T1 of each of the first area A1 and the third area A3.

Further, the first thickness T1 of the first area A1 may be uniform or changed in the airflow direction. Further, the first thickness T1 of the third area A3 may be uniform or changed in the airflow direction.

When the thickness of the first area A1 and the thickness of the third area A3 are each changed in the airflow direction, the thickness of the thickest portion of the second area A2 may be smaller than the average thickness of the first area A1 and the average thickness of the third area A3. The average thickness of the second area A2 may be smaller than the average thickness of the first area A and the average thickness of the third area A3.

Since the plurality of beads 74B included in the coating layer 74 are uniformly distributed, the number of the beads 74B positioned in the second area A2 may be smaller than the number of the beads 74B positioned in the first area A1 or the third area A3, depending on the thickness differences of the areas A1, A2, and A3. The number of the beads 74B may mean the number of beads included in a cross-section cut in the thickness direction of each of the areas A1, A2, and A3.

The blade 62 of the impeller 6 may radially face the small-diameter portion 73C (see FIG. 3) and the expanding portion 73E (see FIG. 3) of the shroud 73, and a portion of the portion coated on the inner circumferential surface of the small-diameter portion 73C and a portion of the portion coated on the inner circumferential surface of the expanding portion 73E of the coating layer 74 may be ground by the blade 62.

In grinding by the blade 62 described above, the first area A1 and the third area A3 that are non-ground portions may be positioned with the second area A2 that is a ground portion therebetween. Further, the blade 62 of the impeller 6 may radially face the second area A2.

When the shroud 73 includes all the small-diameter portion 73C and the large-diameter portion 73D (see FIG. 3) and the expanding portion 73E, the second area A2 may be formed on the inner surface of the small-diameter portion 73C and the inner surface of the expanding portion 73E or on the inner surface of the expanding portion 73E. In this case, the second area A2 may be formed on a portion of the inner surface of the small-diameter portion 73C and may be formed on a portion or the entire of the inner surface of the expanding portion 73E.

However, when the shroud 73 includes the large-diameter portion 73D and the expanding portion 73E without the small-diameter portion 73C, the second area A2 may be formed in the inner surface of the expanding portion 73E. In this case, the second area A2 may be formed on a portion of the inner surface of the expanding portion 73E.

Hereafter, the material of the blade 62, the material of the polymer 74A, and the beads 74B are described.

The blade 62 may be made of a nonmetallic material.

The blade 62 may include polyether ether ketone (hereafter, referred to as PEEK).

The blade 62 may be formed integrally with the hub 61 by injection molding, and in this case, the entire impeller 6 may be made of a nonmetallic material, particularly, PEEK.

PEEK, which is engineering plastic developed by ICI in U.K., is engineering plastic having excellent heat resistance, hardness, and flameproof ability.

The blade 62 may include PEEK 1000, PEEK HPV, PEEK GF30, PEEK CA30, etc., and may have tensile strength of 100 MPa, elongation of 55%, and compression strength of 128 Mpa.

The polymer 74A may be lower in hardness than the impeller 6 that is made of a nonmetallic material, particularly, the blade 62, and can be ground by the blade 62.

It is preferable that the polymer 74A is made of a soft material having hardness of 80% or less of the hardness of the blade 62.

The polymer 74A may be synthetic resin. The polymer 74A may be a material having low bending hardness.

The polymer 74A may include silicon having hardness lower than that of PEEK. For example, the polymer 74A may include Polydimethylsiloxane (PDMS). The silicon has a meaning including silicon compounds.

In this case, the Shore hardness of the polymer 74A may be 30 to 50. In more detail, the polymer 74A may include silicon-based resin having Shore hardness of 30 Shore A to 50 Shore A.

When the hardness of the polymer 74A is less than Shore 30A, the polymer 74A is severely worn, so the gap between the coating layer 74 and the blade 62 may increase and the efficiency of the fan motor may be deteriorated. Further, when the hardness of the polymer 74A exceeds Shore 50A, grinding by the blade 62 may not be smoothly performed or the blade 62 may be worn. Accordingly, it is preferable that the polymer 74A has hardness of 30 Shore A to 50 Shore A.

However, the hardness is not limited thereto and the polymer 74A may include Teflon having hardness lower than PEEK. In this case, the polymer 74A may include polytetra fluoro ethylene (PTFE) or ethylene tetrafluoroethylene (hereafter, referred to as ETFE).

Meanwhile, the beads 74B may be higher in hardness than the polymer 74A and may concentrate stress that is transmitted into the polymer 74A by the blade 62, thereby forming cracks C in the polymer 74A.

The bead 74B may be hard and the polymer 74A may be soft.

The beads 74B may include at least one of metal and ceramic. The beads 74B may be metal powder or ceramic powder.

For example, the beads 74B may include an aluminum oxide that is a kind of ceramic.

The diameter of the beads 74B may be smaller than the length corresponding to the thickness of the polymer 74A. The diameter of the beads 74B may be smaller than the length corresponding to the second thickness T2 of the polymer 74A. When the shapes of the beads 74B are not uniform, the diameter of the beads 74B may mean the diameter d of a circumscribed circle R of the beads 74B.

The diameter of the beads 74B may be 0.01 mm to 0.1 mm. When the diameter of the beads 74B is less than 0.01 mm, the cohesion between the plurality of beads 74B excessively increases, so they may not be uniformly distributed and the manufacturing cost of the beads 74B may increase.

Further, when the diameter of the beads 74B exceeds 0.1 mm, the coating layer 74 may be excessively cut off by grinding by the blade 62. In more detail, when the diameter of the beads 74B is larger than 0.11, the forming density of the cracks C may be relatively reduced in comparison to when the diameter of the beads 74B is 0.1 mm or less. That is, the cracks C may be relatively sparsely formed and a portion of the polymer 74A may be cut off in a large lump by the shape of the cracks C. Further, while the coating layer 74 is ground, the beads 74B may be cut off the polymer 74A and grooves may be formed on the polymer 74A by cutting-off of the beads 74B. In this case, when the diameter of the beads 74B is larger than 0.1 mm, the sizes of the grooves are also large, so the gap between the grooves and the blade 62 may be increased.

It is preferable that the beads 74B are included in the coating layer 74 with weight density such that the blade 62 is not damaged and the polymer 74A can be precisely ground.

The coating layer 74 may include beads 74B of 0.01 wt % to 10 wt %.

Preferably, the coating layer 74 may include beads 74B of 3 wt % to 10 wt %. When the coating layer 74 includes beads 74B less than 3 wt %, the distribution density of the beads 74B is low, so the distances between the beads 74B may increase and cracks C may not be smoothly formed. Further, when the coating layer 74 includes beads 74B more than 10 wt %, the adhesion of the polymer 74A decreases, so the coating layer 74 may not be smoothly bonded to the inner circumferential surface of the shroud 73 or may be separated from the inner circumferential surface.

Figure 8:
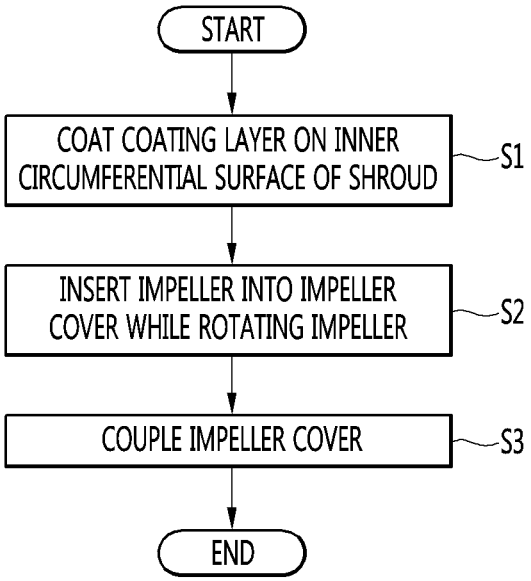
FIG. 8 is a flowchart showing a method of manufacturing a fan motor according to an embodiment of the present invention.
Figure 9:
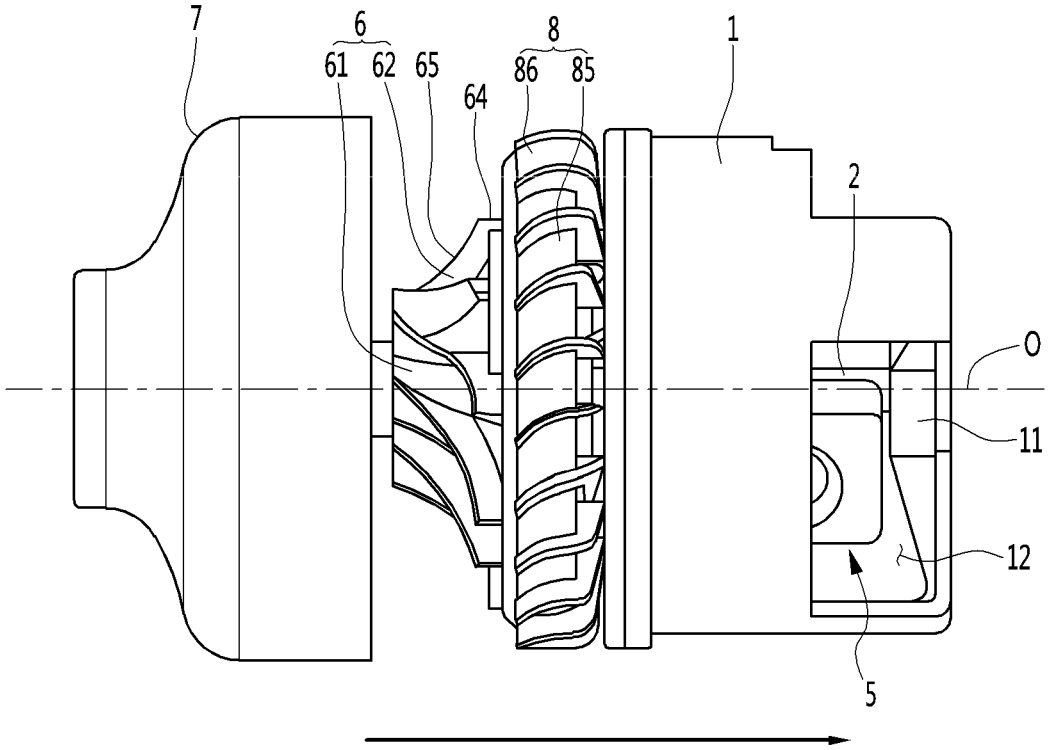
FIG. 9 is a side view before the fan motor according to an embodiment of the present invention is assembled.

FIG. 8 is a flowchart showing a method of manufacturing a fan motor according to an embodiment of the present invention and FIG. 9 is a side view before the fan motor according to an embodiment of the present invention is assembled.

A method of manufacturing a fan motor of the present embodiment may include an impeller cover manufacturing step (S1), an impeller rotating step (S2), and an impeller cover combining step (S3).

The impeller cover manufacturing step (S1) may be a step of manufacturing the impeller cover 7 by forming the coating layer 74 having the first thickness T1 on the inner circumferential surface of the shroud 73 of which the inner diameter increases in an airflow direction.

The impeller cover manufacturing step (S1) may be formed in a preparation process before the fan motor is assembled and the impeller cover 7 may be provided to the assembly line of the fan motor with the coating layer with the first thickness T1 formed on the inner circumferential surface of the shroud 73.

The polymer 74A of the coating layer may be a soft material having hardness lower than the hardness of the blade 62 and the beads 74B may be a hard material having hardness higher than the polymer 74A.

The blade 62 of the impeller 6 that is rotated in the impeller rotating step (S2) may be made of PEEK.

The polymer 94A of the coating layer 74 that is coated in the impeller cover manufacturing step (S1) may be synthetic resin such as silicon and the beads 74B may be metal such as alumina.

The coating layer 74 may be formed coating the polymer 74A mixed with the beads 74B on the inner circumferential surface of the shroud 73.

The coating layer 74 may be formed on the inner circumferential surface of the shroud 73 by spray coating.

However, the coating method of the coating layer 74 is not limited thereto. For example, the coating layer may be formed on the inner circumferential surface of the shroud 73 by electrostatic painting.

The detailed coating process of the coating layer 74 may include a process of adding and mixing the polymer 74A and the beads 74B, a process of repeatedly spray-coating the polymer 74A mixed with the beads 74B to the inner circumferential surface of the shroud 73, and a process of firing the polymer 73A coated on the inner circumferential surface of the shroud 73.

In coating of the coating layer 74 described above, the coating layer 74 may be formed with a uniform first thickness T1 throughout the inner circumferential surface of the shroud 73.

The impeller rotating step (S2) may be a step rotating the impeller 6 having the blade 62 on the hub 61 while inserting the impeller 6 into the impeller cover 7, as shown in FIG. 9.

When the impeller 6 is inserted and rotated, the impeller 6 can be forcibly fitted into the impeller cover 7 with the impeller 6 and the shroud 73 aligned with concentric axis O, and the blade tip 65 of the blade 62 can grind a portion of the coating layer 74 into the second thickness T2 smaller than the first thickness T1 by rubbing on a portion of the coating layer 74.

In this grinding process, the polymer 74A of the coating layer 74 can be ground along cracks C formed to connect at least some of a plurality of beads 74B and the coating layer 74 can be very precisely machined such that the gap between the ground surface 74C of the polymer 74A and the blade 62 of the impeller 6 is small.

In the grinding described above, the coating layer 74 may include the first area A1 and the third area A3 not ground by the blade 62 and a second area A1 ground by the blade 62, and the blade 62 may radially face the second area A1. In more detail, the blade 62 may radially face the surface of the second area A2 that is the ground surface.

The second area A2 may be an area recessed with a thickness smaller than the thickness of the first area A1 and the third area A3, and an end thereof may be stepped from the first area A1 in the airflow direction and the other end may be stepped from the third area A3 in the airflow direction.

As described above, when the second area A2 is stepped from the first area A1 and the third area A3, the interface A12 of the first area A1 and the second area A2, in the first area A1, may axially cover the outer tip of the leading edge 63. The outer tip of the leading edge 63 may the farthest tip fro the hub 61 of the leading edge 63. Further, the interface A23 between the second area A2 and the third area A3, in the third area A3, may radially cover the outer tip of the trailing edge 64. The trailing edge 64 may be the farthest tip from the hub 61.

In the coating layer 74, a blade tip accommodating groove G in which at least a portion of the blade tip 65 is accommodated may be formed between the interface A12 of the first area A1 and the second area A2 and the interface A23 of the second area A2 and the third area A3.

The coating layer 74 having the second thickness T2 remains between the blade tip 65 of the blade 62 and the inner circumferential surface of the shroud 73, and a minimum gap is formed between the blade tip 65 and the coating layer 74.

The impeller cover combining step (S3) may be a step of coupling the impeller cover 7 to the motor housing 1.

The impeller cover 7 may be fastened to the motor housing 1 with the gap formed by an adhesive member such as an adhesive or a fastener such as a screw, and the gap between the impeller 6 and the impeller cover 7 may be maintained without expanding.

Figure 10:
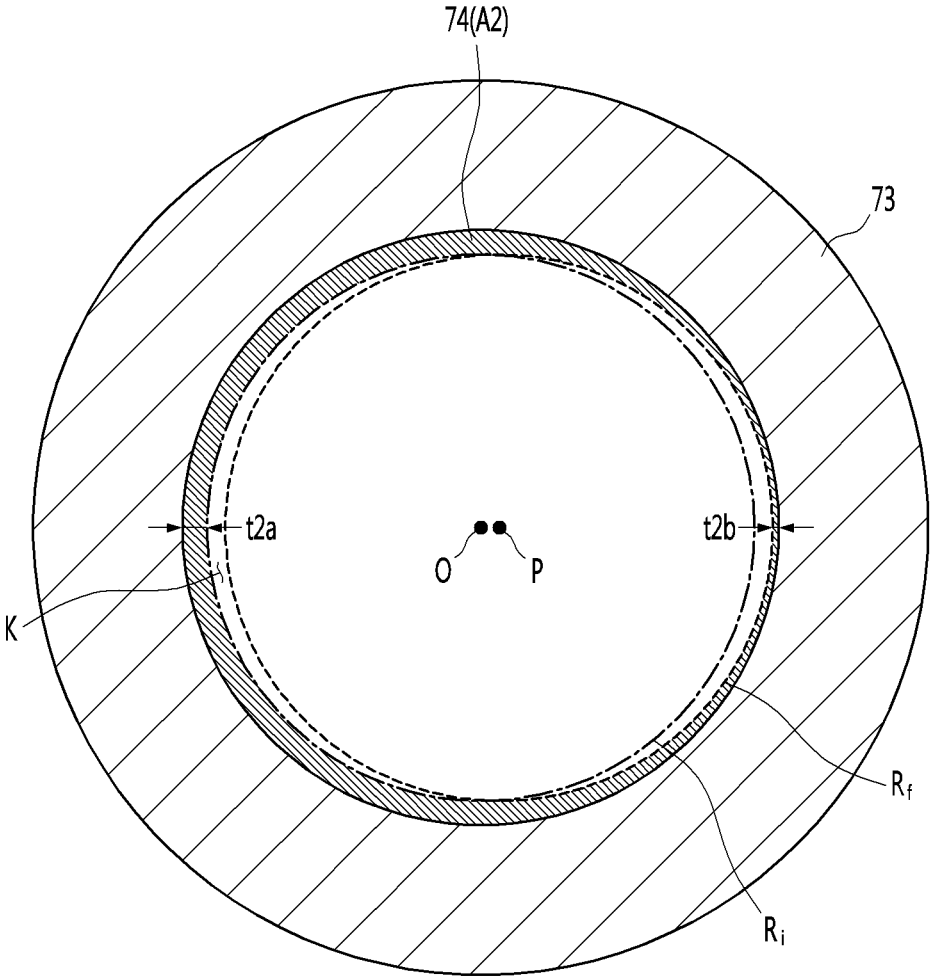
FIG. 10 is a cross-sectional view showing a second area of a coating layer of a fan motor according to another embodiment of the present invention.

FIG. 10 is a cross-sectional view showing a second area of a coating layer of a fan motor according to another embodiment of the present invention.

Hereafter, the repeated configuration is omitted and the difference from the above description is mainly described hereafter with reference to FIGS. 10 and 3.

In a fan motor according to the present embodiment, the rotary shaft 2 may be eccentrically disposed with respect to the center axis O of the shroud 73. In more detail, the center axis P of the rotary shaft 2 and the center axis O of the shroud 73 may be eccentric without meeting.

The center axis P of the rotary shaft 2 and the center axis O of the shroud 73 may be virtual axes.

Since the impeller 6 is connected to the rotary shaft 2 and rotated, the center axis P of the rotary shaft 2 may mean the center axis of the impeller 6 and the impeller 6 and the shroud 73 may not be concentric.

By this configuration, the second area A2 of the coating layer 74 may be non-uniformly ground in the inner circumferential direction of the shroud 73. That is, a portion of the second area A2 may be ground relatively deep and the other portion of the second area A2 may be ground relatively thin. That is, the second thickness T2 of the second area A2 may be changed in the inner circumferential direction of the shroud 73. The second thickness T2 may change from the maximum thickness t2*a* to the minimum thickness t2*b* in the inner circumferential direction of the shroud 73.

As an example of eccentric arrangement of the impeller 6 and the shroud 73, the impeller 6 and the shroud 73 that are coaxially maintained when the fan motor is assembled may become eccentric to each other due to vibration etc. by long-time use of the fan motor.

Before eccentricity is generated between the center axis P of the impeller 6 and the center axis O of the shroud 73, the blade tip 65 of the blade 62 can rotate along a first virtual path Ri and grind the second area A2. Thereafter, when eccentricity is generated between the center axis P of the impeller 6 and the center axis O of the shroud 73, the blade tip 65 of the blade 62 can rotate along a second virtual path Rf and additionally grind a portion of the second area A2.

In this case, the maximum thickness t2*a* of the second thickness T2 of the second area A2 may be the same as the thickness of the second area A2 grounded by the blade 62 before eccentricity is generated between the center axis P of the impeller 6 and the center axis O of the shroud 73. Further, the second thickness T2 of the second area A2 may be formed at the portion where the center axis P of the impeller 6 is eccentric to the center axis O of the shroud 73 and the second area A2 is additionally ground.

When the center axis P of the impeller 6 is eccentric to the center axis O of the shroud 73, a gap K may be formed between the blade 62 and the second area A2.

The gap K may be formed between a portion of the inner circumference of the second area A2 and the blade tip 65. The gap K may change in the circumferential direction of the impeller 6. The gap K may be formed between the area having the maximum thickness t2*a* of the second thickness T2 of the second area A2 and the second movement path Rf.

As another example of eccentric arrangement of the impeller 6 and the shroud 73, the rotary shaft 2 of the impeller 6 may be forcibly inserted eccentrically to the center axis O of the shroud 73 when the fan motor is assembled.

The blade tip 65 of the blade 62 can rotate along the second virtual path Rf and can grind at least a portion of the second area A2.

In this case, at least a portion of the second area A2 facing the impeller 6 in the radial direction of the impeller 6 may have the second thickness T2 smaller than the first thickness T1. That is, at least a portion of the second area A2 can be ground to have the second thickness T2 by the blade 62 of the impeller 6 of which the blade tip 65 rotates along the second virtual path Rf.

When there is severe eccentricity between the center axis P of the impeller 6 and the center axis O of the shroud 73, the thickness of a portion of the second area A2 may be the same as the first thickness that is the thickness of the first area A1. That is, the maximum thickness t2*a* of the thickness of the second area A2 may be the same as the first thickness T1. This is because the blade 62 of the impeller 6 being eccentric to the shroud 73 does not grind a portion of the second area A2.

In this case, the gap K formed between the blade 62 and the second area A2 can be changed in the circumferential direction of the impeller 6 and may be formed between the area having the same thickness as the first thickness T1 of the second thickness T2 of the second area A2 and the second movement path Rf.

The above description merely explains the spirit of the present invention and the present invention may be changed and modified in various ways without departing from the spirit of the present invention by those skilled in the art.

Accordingly, the embodiments described herein are provided merely not to limit, but to explain the spirit of the present invention, and the spirit of the present invention is not limited by the embodiments.

The protective range of the present invention should be construed by the following claims and the scope and spirit of the invention should be construed as being included in the patent right of the present invention.

What is claimed is:

1. A fan motor comprising:

a motor configured to rotate a rotary shaft;

an impeller including a hub connected to the rotary shaft and at least one blade disposed at an outer surface of the hub;

a shroud that surrounds an outer circumference of the impeller; and a coating layer provided at an inner circumferential surface of the shroud, wherein the coating layer has areas having different thicknesses formed by grinding of the at least one blade, wherein the coating layer includes:

a polymer, a hardness of the polymer being less than a hardness of the at least one blade, and a plurality of beads mixed with the polymer, a hardness of the plurality of beads being greater than the hardness of the polymer, wherein the areas of the coating layer include:

a first area having a first thickness; and a second area having a second thickness less than the first thickness and toward the impeller, and wherein a number of beads per unit area of the second area is less than a number of beads per unit area of the first area.

2. The fan motor of claim 1, wherein the areas of the coating layer include an area whose thickness is varied in a circumferential direction of the impeller by grinding of the at least one blade.

3. The fan motor of claim 1, wherein a height of the coating layer is higher than a height of the impeller.

4. The fan motor of claim 1, wherein the areas of the coating layer further include a third area having the first thickness, and wherein the second area is disposed between the first area and the third area with respect to an air flow direction.

5. The fan motor of claim 1, wherein the first thickness is greater than or equal to a minimum distance between the inner circumferential surface of the shroud and the at least one blade.

6. The fan motor of claim 1, wherein the second area includes a ground surface ground by the at least one blade.

7. The fan motor of claim 1, wherein the second thickness is variable along the inner circumferential surface of the shroud.

8. The fan motor of claim 1, wherein a gap between the at least one blade and the second area varies along a circumferential direction of the impeller.

9. The fan motor of claim 1, wherein the at least one blade includes a nonmetallic material.

10. The fan motor of claim 1, wherein the polymer is a synthetic resin, and wherein the plurality of beads include a metal or ceramic material.

11. A fan motor comprising:

a motor configured to rotate a rotary shaft;

an impeller including a hub connected to the rotary shaft and at least one blade disposed at an outer surface of the hub;

a shroud that surrounds an outer circumference of the impeller; and a coating layer provided at an inner circumferential surface of the shroud, wherein the coating layer includes:

a polymer, a hardness of the polymer being less than a hardness of the at least one blade, and a plurality of beads mixed with the polymer, a hardness of the plurality of beads being greater than the hardness of the polymer, wherein the coating layer includes:

a first area having a first thickness, and a second area that faces the impeller in a radial direction of the impeller, at least a portion of the second area having a second thickness less than the first thickness, and wherein the second thickness varies along an inner circumferential direction of the shroud, and wherein a number of beads per unit area of the second area is less than a number of beads per unit area of the first area.

12. The fan motor of claim 11, wherein the rotary shaft is eccentric to an axis of the shroud.

13. The fan motor of claim 11, wherein the at least one blade and the second area are spaced apart from each other, and wherein a gap defined between the at least one blade and the second area varies along the inner circumferential direction of the shroud.

14. The fan motor of claim 11, wherein a thickness of a portion of the second area is equal to the first thickness.

15. A method of manufacturing a fan motor that includes an impeller having a blade and a shroud surrounding an outer circumference of the impeller, the method comprising:

forming a coating layer on an inner circumferential surface of the shroud; and rotating the impeller while inserting the impeller into the shroud to cause the blade to grind at least a portion of the coating layer on the inner circumferential surface of the shroud, wherein an area in which thickness varies in a circumferential direction of the impeller by grinding by the impeller is formed in the coating layer, wherein the coating layer includes:

a polymer having a strength lower than that of the blade of the impeller; and a plurality of beads mixed with the polymer and having a strength higher than that of the polymer, and wherein the polymer is ground along cracks connecting at least some of the plurality of beads.

* * * * *